US011171396B2

(12) United States Patent
Legay et al.

(10) Patent No.: US 11,171,396 B2
(45) Date of Patent: Nov. 9, 2021

(54) BROADBAND POLARIZING SCREEN WITH ONE OR MORE RADIOFREQUENCY POLARIZING CELLS

(71) Applicants: THALES, Courbevoie (FR); INSTITUT NATIONAL DES SCIENCES APPLIQUEES DE RENNES, Rennes (FR)

(72) Inventors: Hervé Legay, Plaisance du Touch (FR); Carlos Molero Jimenez, Rennes (FR); Maria Garcia Vigueras, Rennes (FR)

(73) Assignees: THALES, Courbevoie (FR); INSTITUT NATIONAL DES SCIENCES APPLIQUEES DE RENNES, Rennes (FR)

( * ) Notice: Subject to any disclaimer, the term of this patent is extended or adjusted under 35 U.S.C. 154(b) by 0 days.

(21) Appl. No.: 16/849,941

(22) Filed: Apr. 15, 2020

(65) Prior Publication Data

US 2020/0335842 A1 Oct. 22, 2020

(30) Foreign Application Priority Data

Apr. 18, 2019 (FR) ..... 1904139

(51) Int. Cl.
*H01P 1/165* (2006.01)
*H01Q 15/24* (2006.01)
(Continued)

(52) U.S. Cl.
CPC ..... *H01P 1/165* (2013.01); *H01P 1/17* (2013.01); *H01P 3/12* (2013.01); *H01P 3/123* (2013.01);
(Continued)

(58) Field of Classification Search
CPC .... H01P 1/165; H01P 1/17; H01P 3/12; H01P 3/123; H01Q 15/242; H01Q 15/244
(Continued)

(56) References Cited

U.S. PATENT DOCUMENTS 4,672,334 A * 6/1987 Saad ..... H01P 1/17 333/157
8,933,855 B2 * 1/2015 Nelson ..... H01P 1/165 343/756

FOREIGN PATENT DOCUMENTS

DE 893 819 C 10/1953
EP 3 349 299 A1 7/2018
(Continued)

OTHER PUBLICATIONS

Chen, et al., "A wide-band square-wave guide array polarizer", published in IEEE TAP, vol. 21, No. 3, pp. 389-391, May 1973.
(Continued)

*Primary Examiner* — Robert J Pascal
*Assistant Examiner* — Jorge L Salazar, Jr.
(74) *Attorney, Agent, or Firm* — BakerHostetler

(57) ABSTRACT

A polarizing screen includes an arrangement of at least one, electrically conductive, polarizing cell, which at least one cell is frequency- and polarization-selective, for transforming the polarization of the electric component E of the transverse electromagnetic (TEM) wave, received with linear polarization, into an electromagnetic wave with circular polarization. The four lateral walls of each section of waveguide forming a polarizing cell are each open over their entire length due to a median continuous slot, parallel to the direction of propagation of the incident electromagnetic wave, so as to form four angled electrically conductive plates. Each polarizing cell includes electrically conductive interconnection rods which interconnect the lateral walls and the four angled plates so that they are partially or completely
(Continued)

rigidly connected and which form one or more electrical discontinuities, which are arranged at the ends of or inside the section of waveguide forming the polarizing cell and form one or more inductive or capacitive loads, or one or more (LC) resonators equivalent to an inductor and a capacitor connected in parallel or in series. The longitudinally open slots of the lateral walls and the elementary electrical discontinuities of each polarizing cell include geometric shapes and dimensions which provide total transmission of the incident wave, which is associated with a phase anisotropy of +90° or −90° according to the components $E_V$ and $E_H$.

14 Claims, 15 Drawing Sheets

(51) Int. Cl.
*H01P 1/17* (2006.01)
*H01P 3/12* (2006.01)
*H01P 3/123* (2006.01)

(52) U.S. Cl.
CPC ..... *H01Q 15/242* (2013.01); *H01Q 15/244* (2013.01)

(58) Field of Classification Search
USPC ..... 333/21 A, 21 R, 137, 157; 343/756
See application file for complete search history.

(56) References Cited

FOREIGN PATENT DOCUMENTS

| | | | |
|---|---|---|---|
| FR | 3 038 457 | A1 | 1/2017 |
| JP | 61-199302 | A | 9/1986 |
| JP | H02-250401 | A | 10/1990 |
| WO | 2018/216071 | A1 | 11/2018 |

OTHER PUBLICATIONS

Wang, et al., "Wave 3-D FSSs by 3-D printing technique", published in International Conference on Electromagnetics in Advance Applications (ICEAA) 2016, Cairns (Australia).

Molero, et al., "Design of full-metal polarizing screen based on circuit modeling", published in International Microwave Symposium (IMS), Philadelphia, USA, 2018.

* cited by examiner

BROADBAND POLARIZING SCREEN WITH ONE OR MORE RADIOFREQUENCY POLARIZING CELLS

CROSS-REFERENCE TO RELATED APPLICATIONS

This application claims priority to foreign French patent application No. FR 1904139, filed on Apr. 18, 2019, the disclosure of which is incorporated by reference in its entirety.

FIELD OF THE INVENTION

The present invention relates to a radiofrequency polarizing screen exhibiting high radio performance, produced from an arrangement of one or more polarizing cells that are made of an electrically conductive material and are frequency- and polarization-selective, which allows an incident radiofrequency (RF) signal, received with linear polarization, to be transformed into an output radiofrequency (RF) signal with circular polarization.

The invention also relates to a method for producing a polarizing screen according to the invention.

BACKGROUND

Each polarizing cell of the polarizing screen according to the invention is formed by a section of waveguide, configured to receive, as input, the incident electric field E of the injected RF signal, which is decomposable into two electric field signals $E_V$, $E_H$, the polarizations of which are linear and mutually orthogonal in a first direction, denoted by V and referred to by convention as the "vertical" direction, and a second direction, orthogonal to the first direction, denoted by H and referred to by convention as the "horizontal" direction.

The transformation performed by each polarizing cell consists in applying a phase shift of +90° or −90° between the two components $E_V$ and $E_H$ of the input linear polarization signal E.

The polarizing screen according to the invention is intended to operate in a single RF frequency band, preferably over a wide bandwidth.

The structure of the polarizing screen according to the invention may be made entirely of metal, which structure is particularly suited to the new additive manufacturing methods.

The polarizing screen according to the invention is applicable to any multibeam antenna of low thickness and more particularly to the field of space telecommunications, in particular to antenna for installation on board satellites, or to antennas for use on the ground in fixed or mobile terminals.

It is noteworthy that a polarizing screen according to the invention may be used for antennas which do not allow signals with circular polarization to be synthesized in a straightforward manner, for example the antenna described in patent FR 3038457 B1 forming a first document, said antenna radiating from a long and continuous aperture, using a parallel-plate waveguide beamformer allowing a plurality of beams to be formed over a wide angular sector.

It is known practice to produce polarizing screens or 3D surfaces which are frequency- and polarization-selective on the basis of polarizing cells formed by sections of waveguide in order to overcome the limitations in terms of RF performance and bulk of multilayer polarizing screens which are frequency- and polarization-selective and which use quarter-wave multilayer surfaces with dielectric substrates.

A first known type of waveguide-section polarizing screen is a metal polarizing screen of the OMT (orthogonal mode transducer) polarization duplexer type, which consists of an array of septum or iris waveguides and is described for example in the article by M. Chen and G. Tsandoulas, entitled "A wide-band square-wave guide array polarizer", published in IEEE TAP, Vol. 21, No. 3, pp. 389-391, May 1973, and forming a first document. The septum OMT polarization duplexer described in this first document is a device commonly used in antennas for satellite telecommunications. It usually converts two linear polarized signals, injected into superposed waveguide accesses, into two signals with orthogonal circular polarizations by virtue of a septum blade of optimized profile.

A second type of waveguide-section polarizing screen is a metal dichroic polarizing screen consisting of an array of waveguides with slot resonators.

The article by T. Wang, J. Zhu, C. Wang, J. Ge and Z. Yu, entitled "Wave 3-D FSSs by 3-D printing technique", published in International Conference on Electromagnetics in Advance Applications (ICEAA) 2016, Cairns (Australia), November 2016 and forming a second document, describes a first embodiment of the second type of polarizing screen as a periodic arrangement of polarizing cells which are formed of below-cutoff guided sections, i.e. allowing propagation of a guided mode only beyond the cutoff frequency which is lower than the desired operating frequency, and into the horizontal and vertical walls of which loopless angled resonant slots have been inserted. At the resonant frequency of the slots, the guided sections transmit the radio signal. The parameters of the slots of each polarizing cell are adjusted so as to obtain total transmission over the two components ($E_V$, $E_H$) of the incident electric signal E with linear polarization E, and a phase shift between the two components $E_V$ and $E_H$.

The article by C. Molero, T. Debogovic and M. Garcia-Vigueras, entitled "Design of full-metal polarizing screen based on circuit modeling", published in International Microwave Symposium (IMS), Philadelphia, USA, 2018 and forming a third document, describes a second embodiment of the second type of polarizing screen as a periodic arrangement of polarizing cells which are formed of below-cutoff guided sections, i.e. allowing propagation of a guided mode only beyond the cutoff frequency which is lower than the desired operating frequency, and of metal plates which are placed at the input and at the outputs of the guided sections and into which two pairs of loopless angled resonant slots have been inserted. Each pair of slots resonates with a polarization Ex or Ey. This results in transmission in a frequency band, and it is possible to adjust the anisotropy of the polarizing cells through the design of the slot resonators in terms of shape and dimensions, such that a phase shift of +90° or −90° is obtained between the two transmission coefficients acting on the two components (Ex, Ey) of the incident signal with linear polarization E.

According to a third embodiment of the second type of polarizing screen, it is possible to combine the two techniques used for the first and second embodiments of the second type of screen that are described above.

All of the waveguide-section polarizing screen structures of the first type or of the second type are metal and more straightforward to produce.

However, these structures exhibit a narrow bandwidth, and if resonators are added to the walls of the guided sections to widen the bandwidth, the thickness of the polarizing cells obtained is substantial relative to the wavelength of the electromagnetic signal, which confers an, undesired, high degree of sensitivity with respect to the angle of incidence of the signal injected as input.

The technical problem is to widen the bandwidth of a polarizing screen, the one or more polarizing cells of which are sections of waveguide each having two pairs of electrically conductive lateral walls that are parallel to one another without increasing the thickness of said lateral walls.

SUMMARY OF THE INVENTION

To this end, one subject of the invention is a polarizing screen comprising an arrangement of at least one polarizing cell made of an electrically conductive material, which at least one cell is frequency- and polarization-selective, for transforming the linear polarization of the electric field E of an incident transverse electromagnetic (TEM) wave, which field is received as input and is decomposable into two electric field signals $E_V$, $E_H$, the vertical and horizontal polarizations of which are linear and orthogonal, into a circular polarization of an output electric field, and wherein each polarizing cell includes a section of waveguide having two orthogonal, vertical and horizontal, pairs of lateral walls that are parallel to one another and run longitudinally in a direction of propagation of an incident transverse electromagnetic (TEM) wave.

The polarizing screen is characterized in that the four lateral walls of each polarizing cell are each open over their entire length due to a median continuous slot, parallel to the direction of propagation of the incident electromagnetic wave, so as to form four angled electrically conductive plates; and each polarizing cell includes electrically conductive interconnection rods which interconnect the lateral walls and the four angled plates so that they are partially or completely rigidly connected and which form one or more successive elementary electrical discontinuities, which are arranged at the end of or inside the section of waveguide forming the polarizing cell and form one or more inductive or capacitive loads, or one or more (LC) resonators equivalent to an inductor and a capacitor connected in parallel or in series; and the longitudinally open slots of the lateral walls and the elementary electrical discontinuities of each polarizing cell include geometric shapes and dimensions which provide total transmission of the incident wave, which is associated with a phase anisotropy of +90° or −90° according to the components $E_V$ and $E_H$.

According to particular embodiments, the polarizing screen comprises one or more of the following features, taken alone or in combination:

the sections of waveguide and the interconnecting rods, each forming a polarizing cell, which are electrically conductive, are made of a single electrically conductive homogeneousmaterial, or a first material covered with a second, electrically conductive material;

the single electrically conductive homogeneousmaterial is a metal, or the second, electrically conductive material is a metal;

the median continuous slots of the four lateral walls of each section of waveguide forming a polarizing cell are indented at the input and at the output of the section of the waveguide; or the median continuous slots of a single pair of parallel lateral walls of each section of waveguide forming a polarizing cell are indented at the input and at the output of the section of the waveguide; or the median continuous slots of the four lateral walls of each section of waveguide forming a polarizing cell are without indentation at the input and at the output of the section of the waveguide;

the polarizing cells are dimensioned to operate in a frequency band included in one of the L, S, C, Ku and Ka bands;

each polarizing cell includes solid rods made of electrically conductive material, for interconnecting the lateral walls via an H-shaped interconnection, producing a single elementary electrical discontinuity; and the H-shaped interconnection forming the elementary electrical discontinuity, arranged inside the section of waveguide and substantially in the middle of the length of the polarizing cell, consists of two first, vertical rods of the same length and of a second, horizontal rod linking said two vertical rods substantially at their middles, the two first, vertical rods connecting a pair of, upper and lower, horizontal lateral walls so as to produce a first parallel resonator circuit $L_V$, $C_V$ for a first, vertical polarization, and a second parallel resonator circuit $L_H$, $C_H$ for a second, horizontal polarization, orthogonal to the first, vertical polarization;

each polarizing cell includes rods made of electrically conductive material, for interconnecting the lateral walls via an X-shape, producing a single elementary electrical discontinuity, and the X-shaped interconnection producing the single elementary electrical discontinuity, arranged inside the section of waveguide substantially in the middle of the length of the polarizing cell and symmetrically relative to a longitudinal median plane passing through the section of waveguide, consists of two rods of the same length, inclined relative to a vertical direction but in opposite directions, which intersect substantially at their respective middles while being linked or slightly separated at their middles, and which connect a pair of, upper and lower, horizontal lateral walls so as to produce a first parallel resonator circuit $L_V$, $C_V$ for a first, vertical polarization, and a second parallel resonator circuit $L_H$, $C_H$ for a second, horizontal polarization, orthogonal to the first, vertical polarization;

each polarizing cell includes rods made of electrically conductive material, for interconnecting the lateral walls, via two interconnections, each formed by two vertical rods or vertical pillars without a central connection between them, and each producing an elementary electrical interconnection; and the two, first and second, interconnections producing the two elementary electrical discontinuities, arranged inside the section of waveguide forming the polarizing cell and set back from the respective input and output ends of said section of waveguide, connect the two, lower and upper, horizontal lateral walls so as to produce an inductive load for the first, vertical polarization, parallel to the direction of the vertical rods, and a capacitive load for the second, horizontal polarization, orthogonal to the first, vertical polarization;

each polarizing cell includes rods made of an electrically conductive material, for interconnecting the lateral walls via two successive H-shaped interconnections, producing two elementary electrical discontinuities; and the two, first and second, successive interconnections forming the two elementary discontinuities, arranged inside the section of waveguide forming the polarizing cell and set back from the respective input and output ends of said section of waveguide, each consist of two first, vertical rods of the same length and of a second, horizontal rod linking said two vertical rods substantially at their middles, the two first, vertical rods connecting the, upper and lower, horizontal lateral walls so as each to form a first parallel resonator circuit $L_V$, $C_V$ for the first, vertical polarization, and a second parallel resonator circuit $L_H$, $C_H$ for the second, horizontal polarization, orthogonal to the first, vertical polarization;

each polarizing cell includes rods made of electrically conductive material, for interconnecting the lateral walls via two X-shaped interconnections, producing two elementary electrical discontinuities; and the two, first and second, successive interconnections forming the two elementary discontinuities, arranged inside the section of waveguide forming the polarizing cell and set back from the respective input and output ends of said section of waveguide and symmetrically relative to a vertical median plane passing longitudinally through the section of waveguide, each consist of two rods of the same length, inclined relative to a vertical direction but in opposite directions, which intersect substantially at their respective middles while being linked or slightly separated at their middles, and which connect the two, lower and upper, horizontal lateral walls, so as each to form a first parallel resonator circuit $L_V$, $C_V$ for the first, vertical polarization, and a second parallel resonator circuit $L_H$, $C_H$ for the second, horizontal polarization, orthogonal to the first, vertical polarization; each polarizing cell includes rods made of electrically conductive material, for interconnecting the lateral walls via two, first and second, H-shaped interconnections of a first type, producing two elementary electrical discontinuities of a first type, and via a third H-shaped interconnection, of a second type, producing an elementary electrical discontinuity of a second type; and the two, first and second, H-shaped interconnections of the first type, arranged inside the section of waveguide forming the polarizing cell and set back from the respective input and output ends of said section of waveguide, each consist of two first, vertical rods of the same length and of a second, horizontal rod linking said two vertical rods substantially at their middles, the two first, vertical rods connecting the two, lower and upper, horizontal lateral walls so as each to form a first parallel resonator circuit $L_{V1}$, $C_{V1}$ of a first type for a first, vertical polarization, and a second parallel resonator circuit $L_{H1}$, $C_{H1}$ for a second, horizontal polarization, orthogonal to the first, vertical polarization; and the third H-shaped interconnection, of the second type, arranged inside the section of waveguide and substantially in the middle of the length of the polarizing cell, consists of two third, horizontal rods of the same length and of a fourth, vertical rod linking said two third, horizontal rods substantially at their middles, the two third, horizontal rods connecting the, left and right, vertical lateral walls so as to produce a first parallel resonator circuit $L_{V2}$, $C_{V2}$ of a second type for the first, vertical polarization, and a second parallel resonator circuit $L_{H2}$, $C_{H2}$ of a second type for the second, horizontal polarization;

the polarizing screen includes a lateral supporting structure which laterally surrounds the arrangement of the polarizing cells and to which ends of rods are attached, partially or completely rigidly connecting each polarizing cell; or two parallel plates for guiding and injecting the, linearly polarized, incident electrical signal, which are attached at the end of walls of polarizing cells so as to rigidly connect the polarizing cells of the polarizing screen in cooperation with interconnection rods rigidly connecting groups of polarizing cells;

the arrangement of the polarizing cells is a continuous two-dimensional arrangement of at least three polarizing cells distributed over a regular surface.

Another subject of the invention is a method for producing a polarizing screen such as defined above, the production method being characterized in that the polarizing screen is made entirely of metal, and the production method uses a 3D-printing technique.

BRIEF DESCRIPTION OF THE DRAWINGS

The invention will be better understood on reading the description of several embodiments which will follow, given solely by way of example and while referring to the drawings in which.

DETAILED DESCRIPTION

Generally speaking, a polarizing screen according to the invention comprises an arrangement of at least one polarizing cell made of an electrically conductive material, which at least one cell is frequency- and polarization-selective, for transforming the linear polarization of the electric field E of an incident transverse electromagnetic (TEM) wave, which field is received as input and is decomposable into two electric field signals $E_V$, $E_H$, the polarizations of which are linear and orthogonal, into an output electromagnetic wave with circular polarization.

Each polarizing cell includes a section of waveguide having two orthogonal pairs of lateral walls that are parallel to one another and run longitudinally in a direction of propagation of an incident transverse electromagnetic (TEM) wave.

According to a first feature of the invention, the four lateral walls of each polarizing cell are each open over their entire length due to a median continuous slot, parallel to the direction of propagation of the incident electromagnetic wave, so as to form four angled electrically conductive plates.

According to a second, additional feature, combined with the first, each polarizing cell includes electrically conductive rods which interconnect the lateral walls and the four angled plates so that they are partially or completely rigidly connected and which form one or more elementary electrical discontinuities, which are arranged at the ends of or inside the section of waveguide forming the polarizing cell and form one or more inductive or capacitive loads, or one or more (LC) resonators equivalent to an inductor and a capacitor connected in parallel or in series; and The longitudinally open slots of the lateral walls and the elementary electrical discontinuities of each polarizing cell include geometric shapes and dimensions which are tailored so as to provide total transmission of the incident electromagnetic wave, which is associated with a phase anisotropy of +90° or −90° according to the components $E_V$ and $E_H$.

Figure 1A:
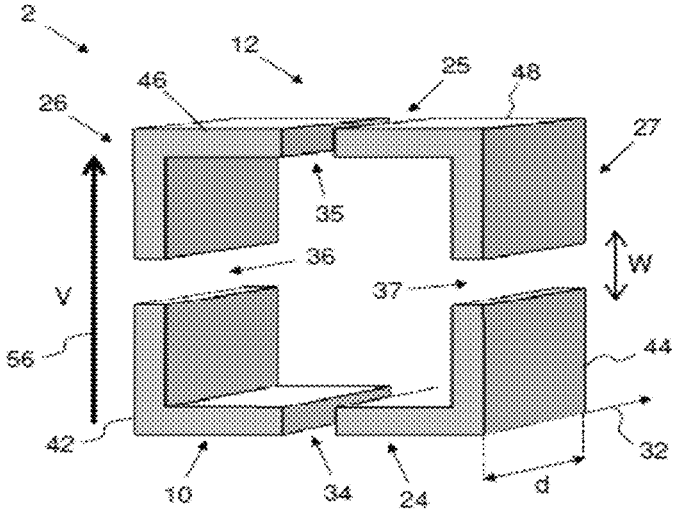
FIG. 1A.

According to FIG. 1A and a general perspective view of a section of a typical waveguide 10 used in a polarizing cell 12 of a polarizing screen 2 according to the invention, the section of waveguide 10 includes two orthogonal pairs of lateral walls 24, 25; 26, 27 that are parallel to one another and run longitudinally in a direction of propagation 32 of an incident transverse electromagnetic (TEM) wave (not shown).

According to the first feature of the invention, the four lateral walls 24, 25, 26, 27 of the polarizing cell are each open over their entire length due to a median continuous slot 34, 35, 36, 37, parallel to the direction of propagation 32 of the incident electromagnetic wave, so as to form four angled electrically conductive plates 42, 44, 46, 48.

Figure 1B:
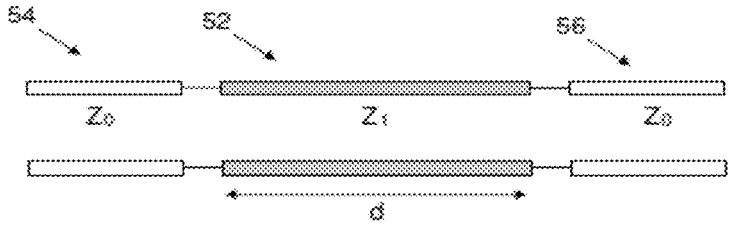
FIG. 1B show a general view of the section of waveguide used in a polarizing cell of a polarizing screen according to the invention and its electrical representation as a transmission line with variable characteristic impedance, respectively.

According to FIG. 1B, the section of waveguide 10 with angled parallel plates of the polarizing cell 12 may be represented, for a given direction of polarization parallel to a direction of a corresponding pair of lateral walls, as a transmission line 52, the characteristic impedance of which, denoted by Z1, is dependent on the dimensions of the guided section 10, in particular on the distance between the walls parallel to the wave polarization in question, and on the aperture w of the two longitudinal slots of the lateral guide walls. The transmission line 52 of characteristic impedance Z1 is interposed between the input 54 and output 56 transmission lines of characteristic impedance Z0 corresponding to propagation in vacuum.

Here, the direction of polarization of the electromagnetic wave in question is the vertical direction V in FIG. 1A, corresponding to the component $E_V$ of the electric field E of the electromagnetic wave in transverse electromagnetic (TEM) mode represented by the vertical arrow 56.

By way of example, the variation in the characteristic impedance is deduced from a characterization of this waveguide structure. Identifying this simplified model using "full-wave" simulations makes it possible to identify the characteristic impedance Z1 as a function of w.

Generally speaking, designing a polarizing cell of a polarizing screen according to the invention involves identifying the equivalent circuits associated with the section of waveguide with angled plates and with the electrically conductive interconnections between plates or lateral walls forming one or more successive electrical discontinuities.

Once the one or more electromagnetic circuits equivalent to a section of guide have been characterized for each, vertical and horizontal, polarization, as described in the example of FIGS. 1A and 1B, it is then possible to characterize, for each polarization, the one or more equivalent circuits of one or more given electrical discontinuities, arranged inside the guided section, and each formed of electrically conductive interconnections between angled plates or lateral walls, and thus to model, for each polarization, the electromagnetic response of a polarizing cell according to the invention having a given configuration in terms of the geometry of the lateral guide walls and of the longitudinal apertures, and of the geometry of the interconnections between plates, forming the elementary electrical discontinuities.

Figure 2A:
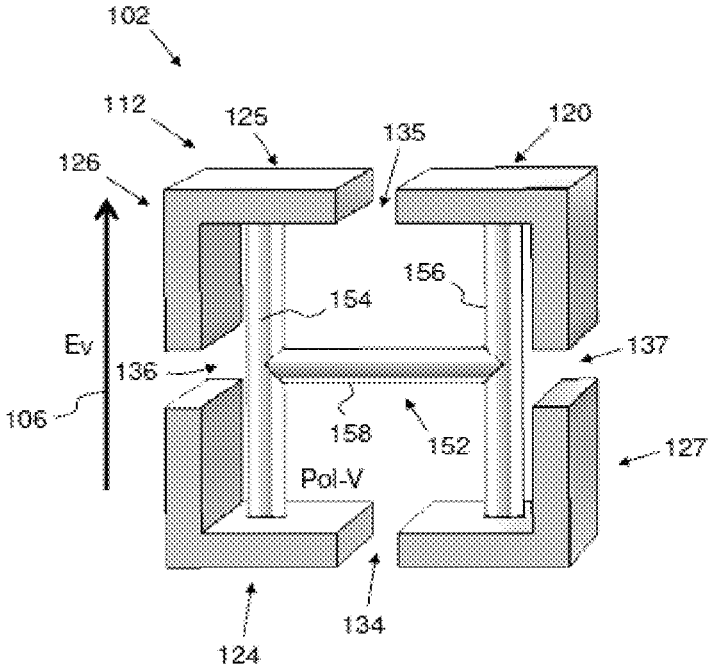
FIG. 2A.
Figure 2B:
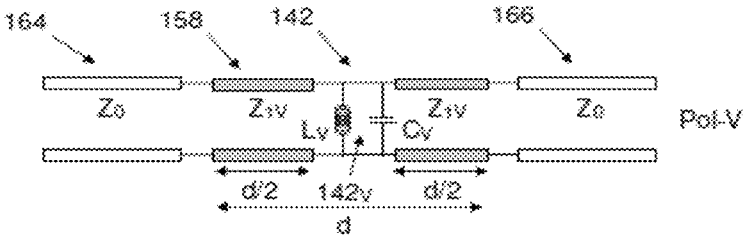
FIG. 2B and FIG. 2D show views of the electrical representations of the polarizing cell as a first transmission line for the vertical polarization V and as a second transmission line for the horizontal polarization H.
Figure 2C:
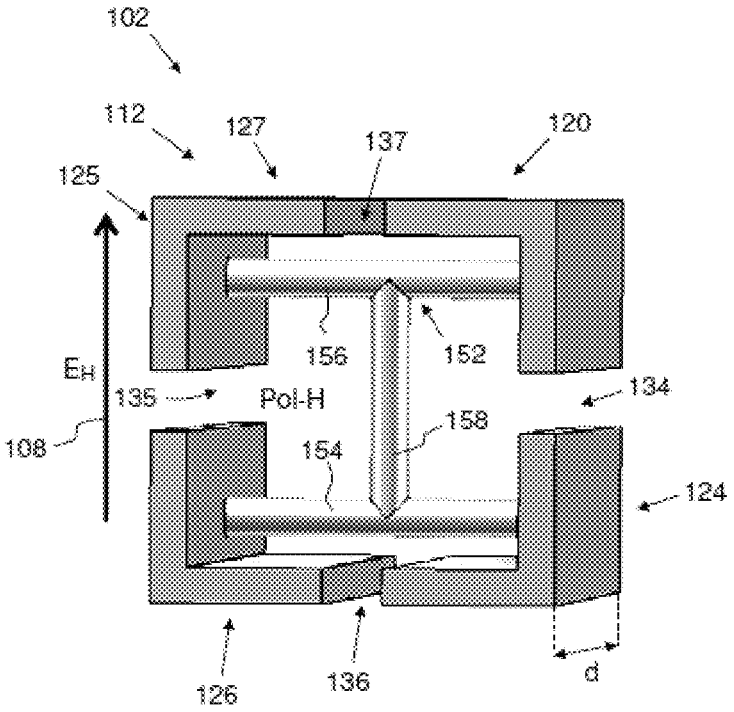
FIG. 2C show views, from two viewing angles with different orientations, corresponding to a vertical polarization V and a horizontal polarization H respectively, of an incident electromagnetic wave with linear polarization, of one and the same first embodiment of a polarizing cell of a polarizing screen according to the invention including a section of waveguide, the four lateral walls of which are each open longitudinally over the entire length of the section due to a median continuous slot and a single electrical discontinuity which is produced via an H-shaped interconnection of electrically conductive rods interconnecting the lateral walls

According to FIGS. 2A and 2C and one and the same first embodiment, a polarizing cell 112 of a polarizing screen 102 according to the invention is illustrated with a first, vertical polarization $E_V$ of the incident electric field E, represented in FIG. 2A by a first, vertical arrow 106, and with a second, horizontal polarization $E_H$ of the incident electric field E, represented in FIG. 2C by a second, horizontal arrow 108, assuming that the polarizing cell 112 of FIG. 2A has rotated clockwise by an angle of +90° on the axis 32 of propagation of the TEM wave in FIG. 2A.

The polarizing cell 112 includes a section of waveguide 120, the four lateral walls 124, 125, 126, 127 of which are each open longitudinally over the entire length of the guided section 120 due to a median continuous slot 134, 135, 136, 137 and a single electrical discontinuity 142 having a vertical component $\mathbf{142}_V$ and a horizontal component $\mathbf{142}_H$ and being produced via an H-shaped interconnection 152 of electrically conductive rods.

The H-shaped interconnection 152 forming the single H-shaped elementary electrical discontinuity 142, arranged inside the section 120 of waveguide and substantially in the middle of the length of the polarizing cell 112, consists of two first, vertical rods 154, 156 of the same length and of a second, horizontal rod 158 linking said two vertical rods 154, 156 substantially at their middles, the two first, vertical rods 154, 156 connecting the horizontal pair of, lower 124 and upper 125, parallel lateral walls so as to produce a first parallel $\mathbf{142}_V$ resonator circuit $L_V$, $C_V$ for the first, vertical polarization, and a second parallel $\mathbf{142}_H$ resonator circuit $L_H$, $C_H$ for the second, horizontal polarization, orthogonal to the first, vertical polarization.

Figure 2D:
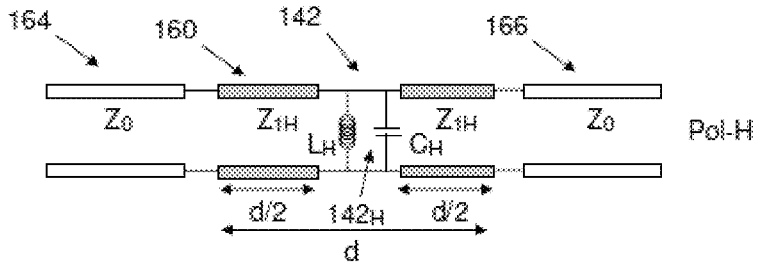

According to FIGS. 2B and 2D corresponding to FIGS. 2A and 2C in terms of polarization component, the electrical representation of the polarizing cell 112 for the first, vertical polarization is a first transmission line 158 of characteristic impedance $Z1_V$, and the electrical representation of the polarizing cell 112 for the horizontal polarization is a second transmission line 160 of characteristic impedance $Z1_H$, the first and second transmission lines 158, 160 each being interrupted by the electrical discontinuity 142 along the vertical component $\mathbf{142}_V$ and the horizontal component $\mathbf{142}_H$.

The first and second transmission lines 158, 160, of respective characteristic impedance $Z1_V$, $Z1_H$, are each interposed between the input 164 and output 166 transmission lines of characteristic impedance Z0 corresponding to propagation in vacuum.

Generally speaking, for an elementary discontinuity corresponding to an interconnection of rods in the shape of an H, a parallel LC circuit is obtained, the values of which vary according to the dimensions of the H-shaped structure, the L and C values being specific to each polarization.

Figure 3:
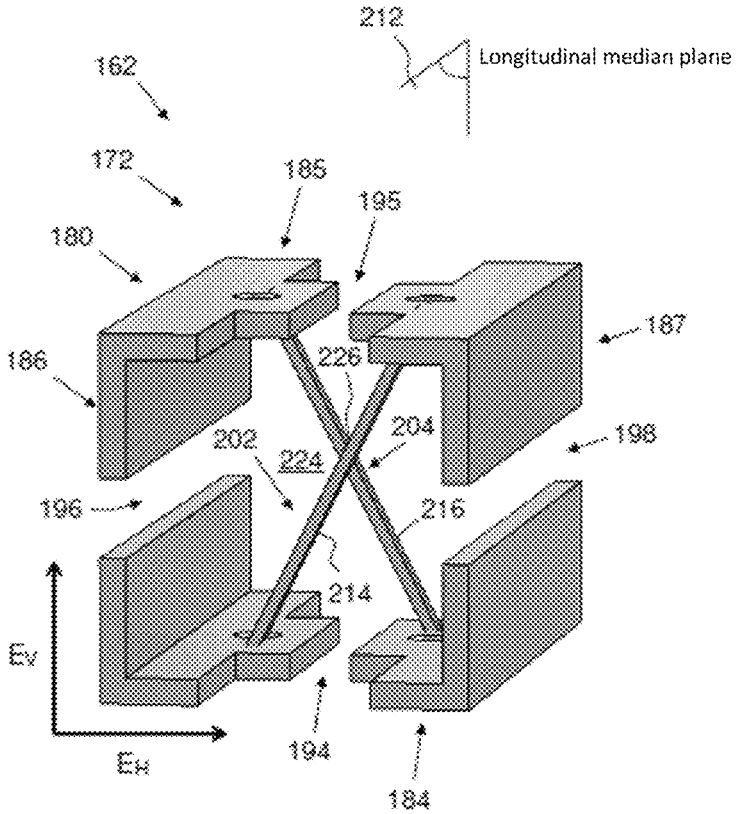
FIG. 3 shows a view of a second embodiment of a polarizing cell of a polarizing screen according to the invention including a section of waveguide, the four lateral walls of which are each open longitudinally over the entire length of the section due to a median continuous slot and a single electrical discontinuity which is produced via an X-shaped interconnection of electrically conductive rods.

According to FIG. 3 and a second embodiment, a polarizing cell 172 of a polarizing screen 162 according to the invention includes a section of waveguide 180, the four lateral walls 184, 185, 186, 187 of which are each open longitudinally over the entire length of the guided section 180 due to a median continuous slot 194, 195, 196, 197 and a single electrical discontinuity 202, produced via an X-shaped interconnection 204 of electrically conductive rods interconnecting the lateral walls.

The X-shaped interconnection 204 producing the elementary electrical discontinuity 202, arranged inside the section 180 of waveguide substantially in the middle of the length of the polarizing cell 172 and symmetrically relative to a longitudinal median plane 212 passing through the section of waveguide 180, consists of two rods 214, 216 of the same length, inclined relative to a vertical direction but in opposite directions, which intersect substantially at their respective middles 224, 226 while being slightly separated at their middles, and which connect the horizontal pair of, lower 184 and upper 185, parallel lateral walls, the respective normals of which are vertical, so as to produce a first parallel resonator circuit $L_V$, $C_V$ for a first, vertical polarization, and a second parallel resonator circuit $L_H$, $C_H$ for a second, horizontal polarization, orthogonal to the first, vertical polarization.

As a variant, the two inclined rods of the X-shaped interconnection intersect substantially at their respective middles while being linked at their middles.

Figure 4A:
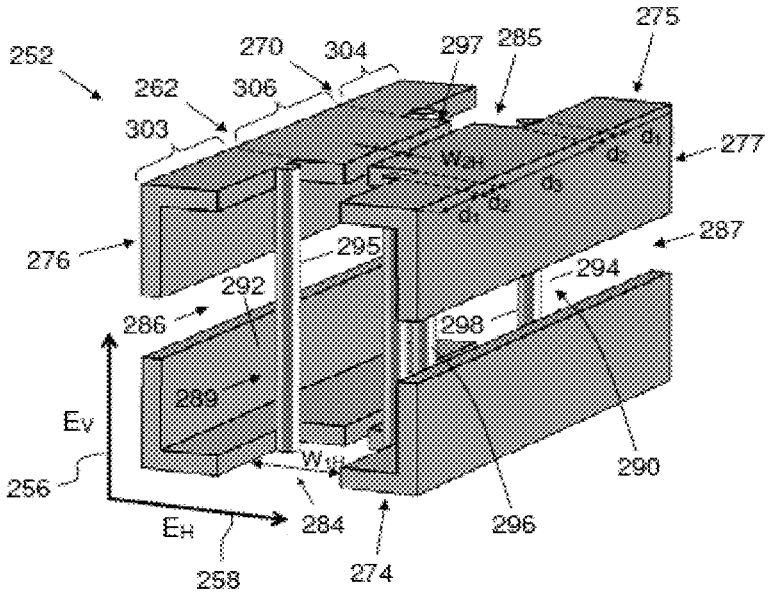
FIG. 4A shows a view of a third embodiment of a polarizing cell of a polarizing screen according to the invention including a section of waveguide, the four lateral walls of which are each open longitudinally over the entire length of the section due to a median continuous slot and two electrical discontinuities which are each produced via an interconnection of two vertical rods, which are not linked to one another, running in the vertical polarization direction and interconnecting the two horizontal lateral walls.

According to FIG. 4A and a third embodiment, a polarizing cell 262 of a polarizing screen 252 according to the invention is illustrated with a first, vertical polarization of the incident electric field, represented by a first, vertical arrow 256 in FIG. 4A, and a second, horizontal polarization of the incident electric field, represented by a second, horizontal arrow 258.

The polarizing cell 262 includes a section of waveguide 270, the four lateral walls 274, 275, 276, 277 of which are each open longitudinally over the entire length of the guided section 270 due to a median continuous slot 284, 285, 286, 287 and two elementary electrical discontinuities 292, 294, each consisting of an interconnection 289, 290 of two parallel electrically conductive pillars 295, 296; 297, 298 which are not linked to one another.

The two interconnections 289, 290 forming the first 292 and second 294 elementary electrical discontinuities, respectively, arranged inside the section of waveguide 270 and set back from the respective input and output ends of said section of waveguide 270, connect the pair of, lower 274 and upper 275, parallel lateral walls so as each to produce an inductive load $L_V$ 299, 300 for a first, vertical polarization, parallel to the direction of the vertical rods 295, 296, 297, 298, and a capacitive load $C_H$ 301, 302 for a second, horizontal polarization, orthogonal to the first, vertical polarization.

In addition, it is noteworthy that the two horizontal median continuous slots 284, 285 of the pair of, lower 274 and upper 275, horizontal lateral walls of the section of waveguide 270 are indented at the input and at the output of the section of waveguide 270. The two horizontal slots 284, 286 each pass through two horizontal guide end segments at the input 303 and output 304 of the guided section with a first horizontal width $W1_H$, and pass through an intermediate horizontal guide segment 306 with a first horizontal width $W2_H$, smaller than the first horizontal width $W1_H$.

The first electrical discontinuity 292 divides the horizontal guide segment located at the input 303 of the guided section into two portions of second, horizontal polarization transmission line having one and the same horizontal characteristic impedance $Z1_H$ and respective lengths d1 and d2 in the direction of the output of the guided section, the length of which is denoted by d.

The second electrical discontinuity 294 divides the horizontal guide segment located at the output 304 into two portions of second, horizontal polarization transmission line having one and the same horizontal characteristic impedance $Z1_H$ and respective lengths d2 and d1 in the direction of the output of the guided section, the length of which is denoted by d.

The length of the intermediate guide segment 306 is denoted by d3 and defines a portion of second, horizontal polarization transmission line having a second horizontal characteristic impedance $Z2_H$.

The two vertical median continuous slots of the pair of, left and right, vertical lateral walls of the section of waveguide are without indentations. The two vertical slots each pass through one and the same vertical guide segment over the entire length with one and the same vertical width $W1_V$ and a vertical characteristic impedance $Z1_V$.

Figure 4B:
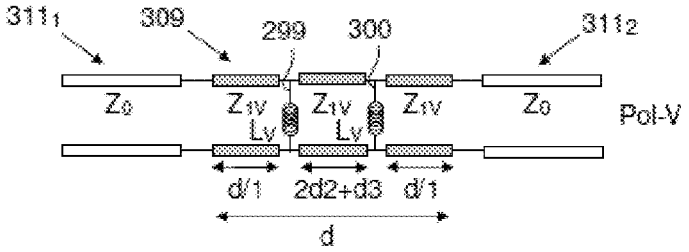
FIG. 4B and FIG. 4C show views of the electrical representations of the polarizing cell, corresponding to the vertical polarization V and to the horizontal polarization H, as a first transmission line and as a second transmission line, respectively.

According to FIG. 4B, the electrical representation of the polarizing cell 262 for the first, vertical polarization is a first transmission line 309 interrupted by the first inductive load $L_V$ 299 corresponding to the first electrical discontinuity 292 and the first, vertical polarization, and the second inductive load 300 of the same value $L_V$, corresponding to the second electrical discontinuity 294, the first and second inductive loads $L_V$ 299, 300 being connected at the input and at the output, respectively, of the portion of line of characteristic impedance $Z1_V$ of length d1.

Figure 4C:
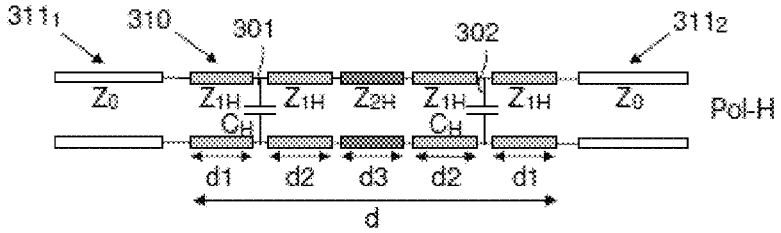

According to FIG. 4C, the electrical representation of the polarizing cell 262 for the second, horizontal polarization is a second transmission line 310 in which the first capacitive load $C_H$ 303, corresponding to the first electrical discontinuity 292 and the second, horizontal polarization, is connected at the input of the portion of line of characteristic impedance $Z1_H$, located downstream of the first discontinuity 292 and of length d2, and the second capacitive load of the same value $C_H$, corresponding to the second electrical discontinuity and the second, horizontal polarization, is connected at the output of the portion of line of characteristic impedance $Z1_H$, located upstream of the second discontinuity and of length d2.

Thus, an interconnection consisting of two vertical metal wires produces an inductive load for the polarization parallel to the wires, and a capacitive load for the polarization orthogonal to the wires.

The first and second transmission lines 309, 310 are each interposed between the input $311_1$ and output $311_2$ transmission lines of characteristic impedance Z0 corresponding to propagation in vacuum.

Figure 5A:
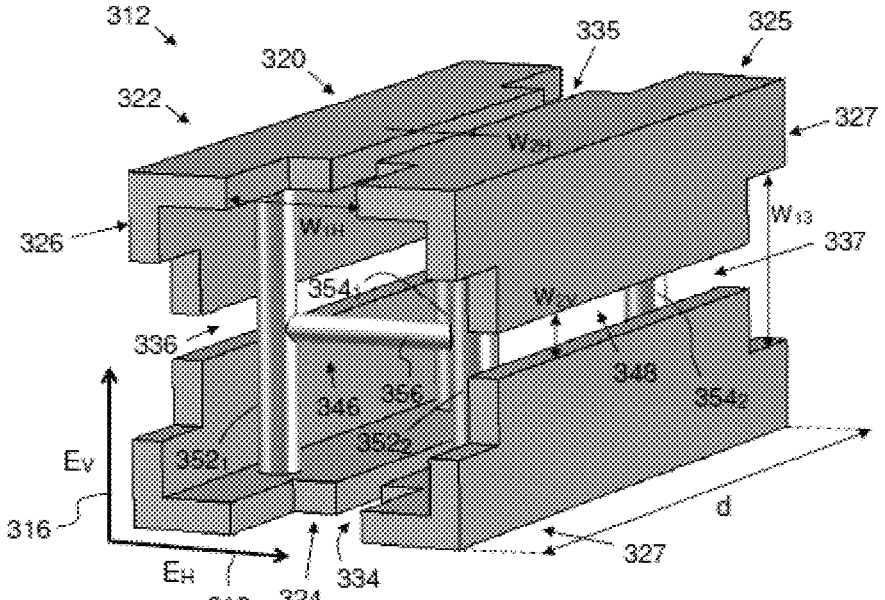
FIG. 5A shows a view of a fourth embodiment of a polarizing cell of a polarizing screen according to the invention including a section of waveguide, the four lateral walls of which are each open longitudinally over the entire length of the section due to a median continuous slot and two electrical discontinuities which are each produced via an H-shaped interconnection of rods interconnecting the lateral walls.

According to FIG. 5A and a fourth embodiment, a polarizing cell 322 of a polarizing screen 312 according to the invention is illustrated with a first, vertical polarization of the incident electric field, represented by a first, vertical arrow 316 in FIG. 5A, and a second, horizontal polarization of the incident electric field, represented by a second, horizontal arrow 318.

The polarizing cell 322 includes a section of waveguide 320, the four lateral walls 324, 325, 326, 327 of which are each open longitudinally over the entire length of the guided section 320 due to a median continuous slot 334, 335, 336, 337 and two successive elementary electrical discontinuities 342, 344, each consisting of an electrically conductive H-shaped interconnection 346, 348.

The two interconnections 346, 348, forming the two elementary electrical discontinuities 342, 344 and arranged inside the section of waveguide 320 and set back from the respective input and output ends of said section of waveguide 320, each consist of two first, vertical rods $352_1$, $352_2$; $354_1$, $354_2$ of the same length and of one second, horizontal rod 356, 358 substantially linking said two first, vertical rods $352_1$; $352_2$; $354_1$, $354_2$ at their middles, the two first, vertical rods $352_1$, $352_2$; $354_1$, $354_2$ connecting the two, lower 324 and upper 325, vertical parallel lateral walls so as each to produce a first parallel resonator circuit $L1_V$, $C1_V$ for the first, vertical polarization, parallel to the direction of the first interconnection rods, and a second parallel resonator circuit $L2_H$, $C2_H$ for a second, horizontal polarization, orthogonal to the first, vertical polarization.

In addition, it is noteworthy that the four median continuous slots 334, 335, 336, 337 of the four lateral walls 324, 325, 326, 327 of the section of waveguide 320 are here indented at the input and at the output of the section of waveguide.

The two horizontal slots 334, 335 each pass through two horizontal guide end segments at the input and output of the guided section with a first horizontal width $W1_H$, and pass through an intermediate horizontal guide segment with a first horizontal width $W2_H$, smaller than the first horizontal width $W1_H$.

The two input and output horizontal guide end segments are each the same length d1 and each define a, first and fifth, portion of transmission line for the second, horizontal polarization having a first horizontal characteristic impedance $Z1_H$.

The first electrical discontinuity 342 and the second electrical discontinuity 344 divide the intermediate horizontal guide segment into three, second, third and fourth, portions of transmission line for the second, horizontal polarization, each having one and the same second horizontal characteristic impedance $Z2_H$ and respective lengths d2, d3 and d2. The first electrical discontinuity, connected between the second portion and the third portion of transmission line for the second, horizontal polarization, and the second electrical discontinuity, connected between the third and fourth portions of transmission line for the second, horizontal polarization, are separated by the distance d3. The lengths d1, d2, d3, and d here satisfy the following equation: d=2*d1+2*d2+d3, the symbol "*" denoting the multiplication operator.

The two vertical slots 336, 337 each pass through two horizontal guide end segments at the input and output of the guided section with a first vertical width $W1_V$, and pass through an intermediate vertical guide segment with a first vertical width $W2_V$, smaller than the first vertical width $W1_V$.

The two input and output vertical guide end segments are each the same length d1 and each define a, first and fifth, portion of transmission line for the first, vertical polarization having a first vertical characteristic impedance $Z1_H$.

The first electrical discontinuity 342 and the second electrical discontinuity 344 divide the intermediate vertical guide segment into three, second, third and fourth, portions of transmission line for the first, vertical polarization, each having one and the same second horizontal characteristic impedance $Z2_H$ and respective lengths d2, d3 and d2. The first electrical discontinuity, connected between the second portion and the third portion of transmission line for the first, horizontal polarization, and the second electrical discontinuity, connected between the third and fourth portions of transmission line for the first, vertical polarization, are separated by the distance d3. The lengths d1, d2, d3, and d here satisfy the following equation: d=2*d1+2*d2+d3, the symbol "*" denoting the multiplication operator.

Figure 5B:
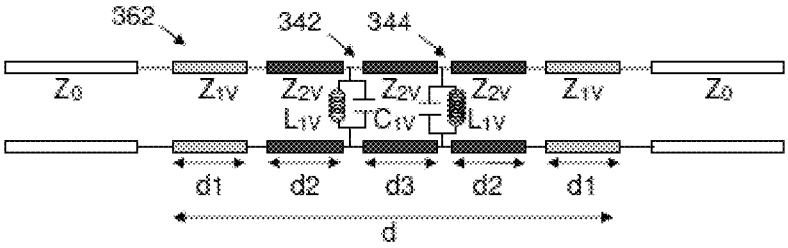
FIG. 5B and FIG. 5C show views of the electrical representations of the polarizing cell, corresponding to the vertical polarization and to the horizontal polarization, as a first transmission line and as a second transmission line, respectively.

According to FIG. 5B, the electrical representation of the polarizing cell 322 for the first, vertical polarization is a first transmission line 362 in which a parallel first first parallel resonator $L1_V$, $C1_V$ corresponding to the first electrical discontinuity and the first, vertical polarization, and a parallel second first parallel resonator $L1_V$, $C1_V$ corresponding to the second electrical discontinuity and the first, vertical polarization, are connected at the input of the third portion and at the output of the third portion of line portion of the intermediate segment of second vertical characteristic impedance $Z2_V$ respectively.

Figure 5C:
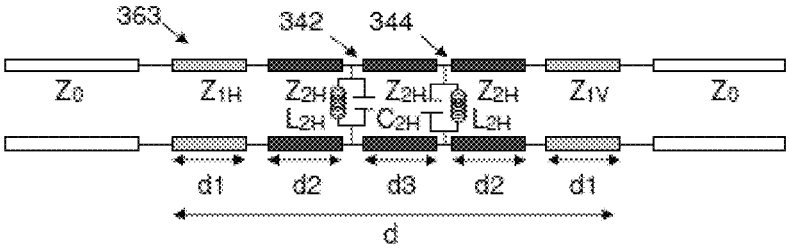

According to FIG. 5C, the electrical representation of the polarizing cell 322 for the second, horizontal polarization is a second transmission line 363 in which a parallel first second parallel resonator $L2_H$, $C2_H$ corresponding to the first electrical discontinuity and the second, horizontal polarization, and a parallel second parallel resonator $L2_H$, $C1_H$ corresponding to the second electrical discontinuity and the second, horizontal polarization, are connected at the input of the third portion and at the output of the third portion of line portion of the intermediate segment having for its characteristic impedance the second horizontal characteristic impedance $Z2_H$.

As a variant, the positions of the indentations along the horizontal slots and the vertical slots may differ from one another and/or the positions of the elementary electrical discontinuities in relation to the indentations may vary.

Figure 6:
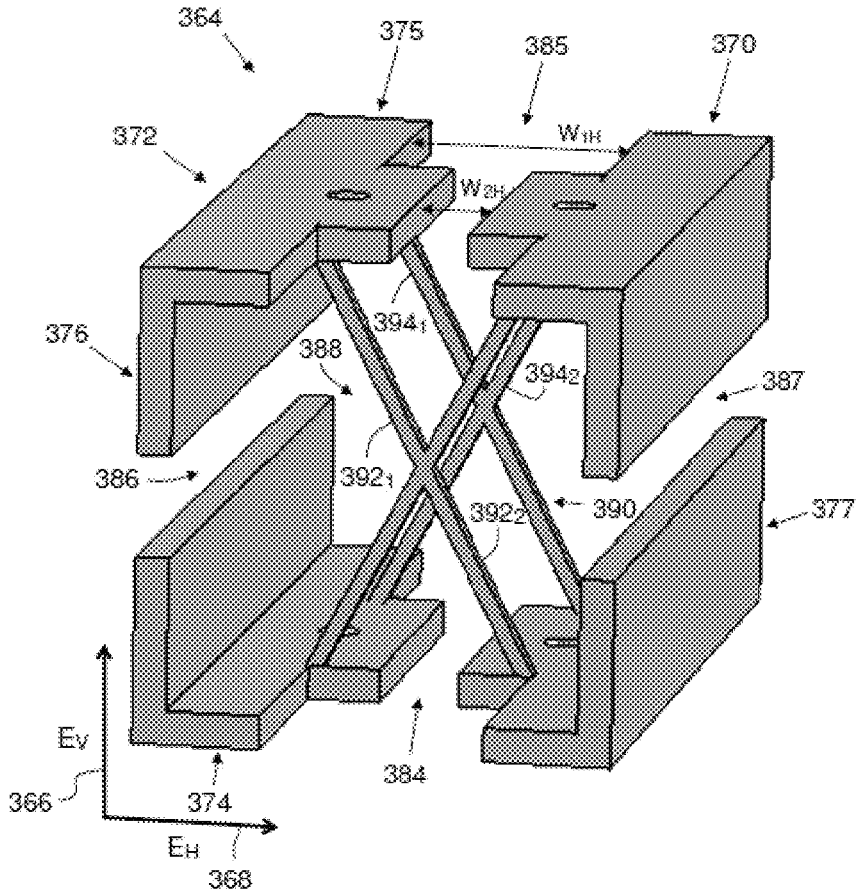
FIG. 6 shows a view of a fifth embodiment of a polarizing cell of a polarizing screen according to the invention including a section of waveguide, the four lateral walls of which are each open longitudinally over the entire length of the section due to a median continuous slot and two successive electrical discontinuities which are each produced via an X-shaped interconnection of rods interconnecting the lateral walls.

According to FIG. 6 and a fifth embodiment, a polarizing cell 372 of a polarizing screen 364 according to the invention is illustrated with a first, vertical polarization of the incident electric field, represented by a first, vertical arrow 366 in FIG. 6, and a second, horizontal polarization of the incident electric field, represented by a second, horizontal arrow 368.

The polarizing cell 372 includes a section of waveguide 370, the four lateral walls 374, 375, 376, 377 of which are each open longitudinally over the entire length of the guided section 370 due to a median continuous slot 384, 385, 386, 387 and two elementary electrical discontinuities 392, 394, each consisting of an X-shaped interconnection 388, 390 of electrically conductive rods interconnecting the lateral walls.

The two interconnections 388, 390, forming the two, first 392 and second 394, elementary electrical discontinuities, arranged inside the section of waveguide 370 forming the polarizing cell 372 and set back from the respective input and output ends of said section of waveguide 370 and symmetrically relative to a vertical median plane passing longitudinally through the section of waveguide, each consist of two rods $392_1$, $392_2$; $394_1$, $394_2$ of the same length, inclined relative to a vertical direction but in opposite directions, which intersect substantially at their respective middles while being linked and which interconnect the two, lower 374 and upper 375, horizontal parallel walls, so as each to produce a first parallel resonator circuit $L1_V$, $C1_V$ for the first, vertical polarization, and a second parallel resonator circuit $L2_H$, $C2_H$ for the second, horizontal polarization, orthogonal to the first, vertical polarization.

Here, like for the polarizing cell of FIG. 4A, the two horizontal median continuous slots 384, 385 of the pair of, lower 374 and upper 375, horizontal lateral walls are indented at the input and at the output of the section of waveguide 370. The two horizontal slots 384, 385 each pass through two horizontal guide end segments at the input and output of the guided section 370 with a first horizontal width $W1_H$, and pass through an intermediate horizontal guide segment with a second horizontal width $W2_H$, smaller than the first horizontal width $W1_H$.

Figure 7A:
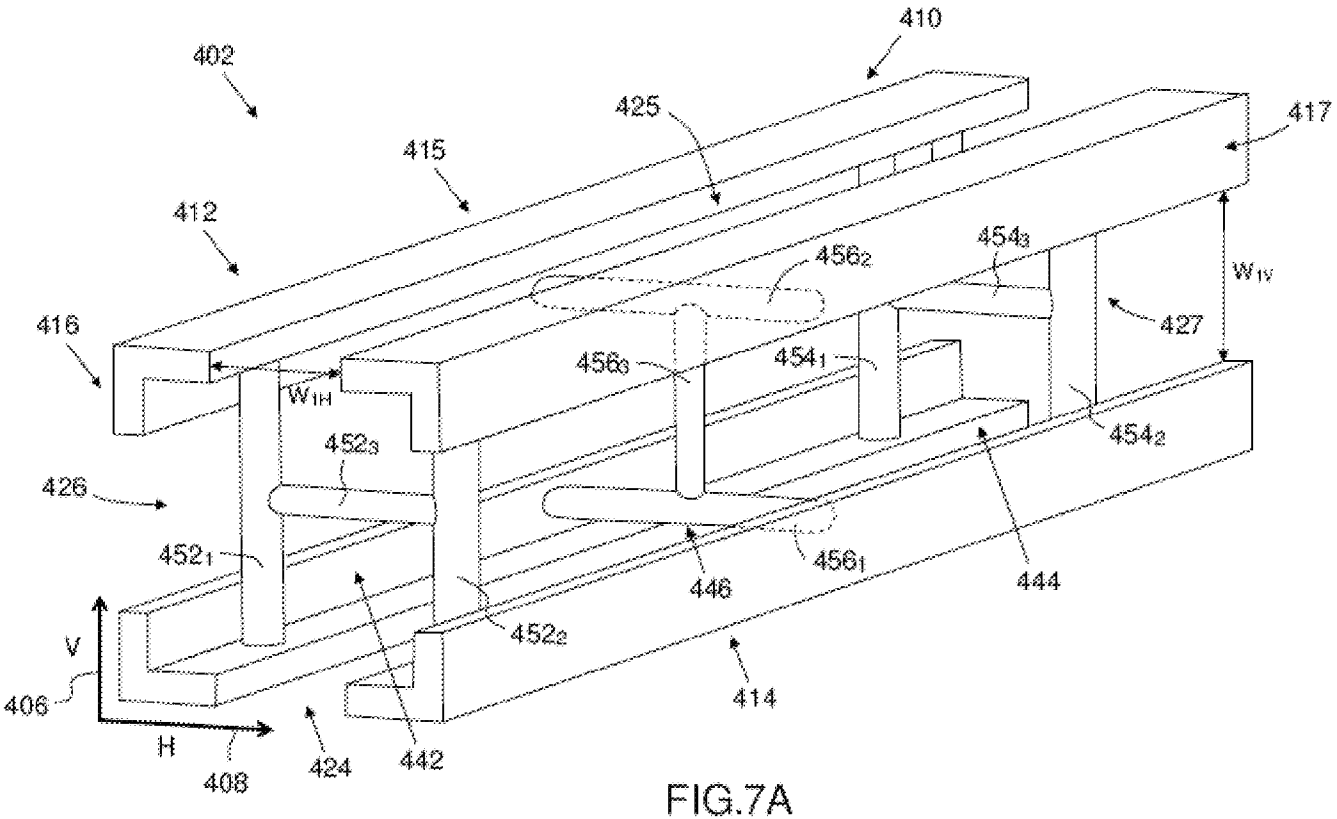
FIG. 7A shows a view of a sixth embodiment of a polarizing cell of a polarizing screen according to the invention including a section of waveguide, the four lateral walls of which are each open longitudinally over the entire length of the section due to a median continuous slot, two electrical discontinuities of a first type, which are produced via two successive interconnection of rods in a vertical H-shape interconnecting the lateral walls, and one electrical discontinuity of a second type, produced via an interconnection of rods in a horizontal H-shape interconnecting the lateral walls.

According to FIG. 7A and a sixth embodiment, a polarizing cell 412 of a polarizing screen 402 according to the invention is illustrated with a first, vertical polarization of the incident electric field, represented by a first, vertical arrow 406 in FIG. 7A, and a second, horizontal polarization of the incident electric field, represented by a second, horizontal arrow 408.

The polarizing cell 412 includes a section of waveguide 410, the four lateral walls 414, 415, 416, 417 of which are each open longitudinally over the entire length of the guided section 410 due to a median continuous slot 424, 425, 426, 427, two, first 432 and second 434, input and output end, elementary electrical discontinuities, each formed by an H-shaped interconnection 442, 444 of a first type, and a third, intermediate, electrical discontinuity 436 arranged between the first and second end elementary discontinuities 432, 434, and formed by an H-shaped interconnection 446 of a second type.

The two, first and second, H-shaped interconnections 442, 444 of the first type, forming the first and second elementary electrical discontinuities 432, 434, arranged inside the section of waveguide 410 and set back from the respective input and output ends of said section of waveguide 410, each consist of two first, vertical rods $452_1$, $452_2$; $454_1$, $454_2$ of the same length and of one second, horizontal rod $452_3$; $454_3$ substantially linking said two first, vertical rods $452_1$, $452_2$; $454_1$, $454_2$ at their middles, connecting a pair of, lower 414 and upper 415, parallel horizontal lateral walls so as each to produce a first, vertical parallel resonator circuit $L1_V$, $C1_V$ of the first type for the first, vertical polarization, and a second, horizontal parallel resonator circuit $L1_H$, $C1_H$ for a second, horizontal polarization, orthogonal to the first, vertical polarization.

The third H-shaped interconnection 446 of the second type, forming the third elementary discontinuity 436, arranged inside the section of waveguide 410 and substantially in the middle of the length of the polarizing cell 412, between the first and second elementary electrical discontinuities 432, 434, consists of two horizontal rods $456_1$, $456_2$ of the same length and of one vertical rod $456_3$ linking said two horizontal rods $456_1$, $456_2$ substantially at their middles, the two first, horizontal rods $456_1$, $456_2$ connect the, left 416 and right 417, vertical parallel lateral walls, the normal of which is horizontal, so as to produce a second vertical parallel resonator circuit $L2_V$, $C2_V$ of the second type for the first, vertical polarization, and a second horizontal parallel resonator circuit $L2_H$, $C2_H$ of the second type for the second, horizontal polarization.

Here, the median continuous slots 424, 425, 426, 427 of the four lateral walls 414, 415, 416, 417 of the section of waveguide 320 are without indentation at the input and at the output of the section of the waveguide 410.

The two vertical slots 426, 427 each pass, from the input to the output, through four vertical guide segments of the guided section with one and the same vertical width $W1_V$ which successively define first, second, third and fourth portions of transmission line for the first, vertical polarization V having one and the same vertical characteristic impedance $Z1_V$.

For the first, vertical polarization V, the first vertical impedance line portion between the guided section input and the first vertical elementary electrical discontinuity of the first type, the second vertical impedance line portion between the first vertical elementary electrical discontinuity of the first type and the third vertical elementary electrical discontinuity of the second type, the third vertical impedance line portion between the third vertical elementary electrical discontinuity of the second type and the second vertical elementary electrical discontinuity of the first type, and the fourth vertical impedance line portion between the second vertical elementary electrical discontinuity of the first type and the guide section output have first, second, third and fourth lengths d1, d2, d2 and d1, respectively, satisfying the equation: 2*(d1+d2)=d, d denoting the length of the guided section.

The two horizontal slots 424, 425 each pass, from the input to the output, through four horizontal guide segments of the guided section with one and the same horizontal width $W1_H$ which successively define a first, second, third and fourth portions of transmission line for the second, horizontal polarization H having one and the same horizontal characteristic impedance $Z1_H$.

For the second, horizontal polarization H, the first horizontal impedance line portion between the guided section input and the first horizontal elementary electrical discontinuity of the first type, the second horizontal impedance line portion between the first horizontal elementary electrical discontinuity of the first type and the third horizontal elementary electrical discontinuity of the second type, the third horizontal impedance line portion between the third horizontal elementary electrical discontinuity of the second type and the second horizontal elementary electrical discontinuity of the first type, and the fourth horizontal impedance line portion between the second horizontal elementary electrical discontinuity of the first type and the guide section output have first, second, third and fourth lengths d1, d2, d2 and d1, respectively, satisfying the equation: 2*(d1+d2)=d, d denoting the length of the guided section.

Figure 7B:
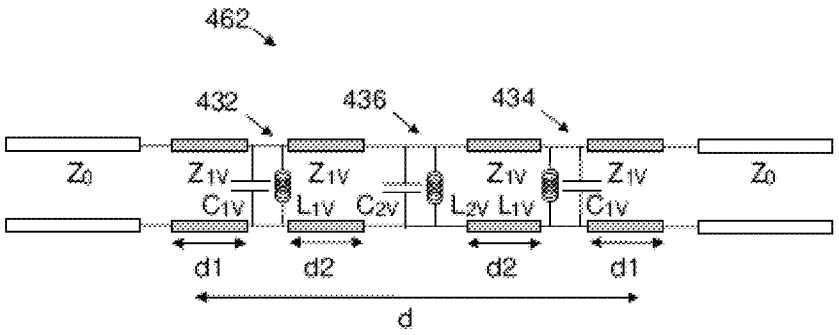
FIG. 7B and FIG. 7C show views of the electrical representations of the polarizing cell, corresponding to the vertical polarization V and to the horizontal polarization H, as a first transmission line and as a second transmission line, respectively.

According to FIG. 7B, the electrical representation of the polarizing cell 412 for the first, vertical polarization is a first transmission line 462 in which a first parallel resonator $L1_V$, $C1_V$ corresponding to the first electrical discontinuity of the first type and the first, vertical polarization, a second first parallel resonator $L1_V$, $C1_V$ corresponding to the second electrical discontinuity of the first type and the first, vertical polarization, and a single second parallel resonator $L2_V$, $C2_V$ corresponding to the third electrical discontinuity of the second type and the first, vertical polarization are connected at the input of the second line portion, at the output of the third line portion and at the input of the third line portion, respectively, of the first transmission line 452.

Figure 7C:
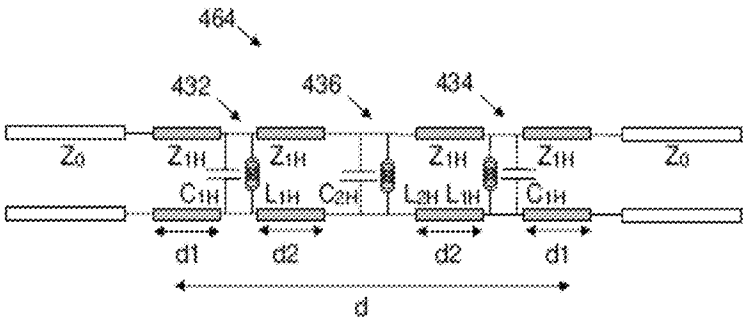

According to FIG. 7C, the electrical representation of the polarizing cell 412 for the second, horizontal polarization is a second transmission line 464 in which a first parallel resonator $L1_H$, $C1_H$ corresponding to the first electrical discontinuity of the first type and the second, horizontal polarization, a second first parallel resonator $L1_H$, $C1_H$ corresponding to the second electrical discontinuity of the first type and the second, vertical polarization, and a single second parallel resonator $L2_H$, $C2_H$ corresponding to the third electrical discontinuity of the second type and the second, horizontal polarization are connected at the input of the second line portion, at the output of the third line portion and at the input of the third line portion, respectively, of the second transmission line 454.

Generally speaking, the polarizing cell includes one elementary electrical discontinuity or a succession of elementary electrical discontinuities forming capacitive or inductive loads, or LC circuits, in parallel or in series, which allow the polarizing cell to be modelled as a bandpass circuit for each of the, vertical and horizontal, polarizations.

Generally speaking, the sections of waveguide and the interconnecting rods forming each polarizing cell are electrically conductive.

According to a first embodiment, the sections of waveguide and the interconnecting rods forming each polarizing cell are made of a single homogeneouselectrically conductive material.

According to a second embodiment, the sections of waveguide and the interconnecting rods forming each polarizing cell are made of a single homogeneouselectrically conductive material.

In particular, the single electrically conductive homogeneousmaterial is a metal, or the second, electrically conductive material is a metal.

When the structure of the one or more polarizing cells of the polarizing screen is made entirely of metal, the polarizing screen exhibits low transmission losses independent of the transmitting or receiving mode of the application used, and is compatible with high-power applications.

An entirely metal structure for the polarizing cells allows the polarizing screen according to the invention to be produced by additive manufacturing using a 3D printing technique.

The polarizing cells of the polarizing screen according to the invention exhibit a very wide bandwidth and lateral guide walls of low thickness relative to the transmission wavelength. Using guided sections based on angled parallel plates makes it possible to avoid introducing frequency dispersion into the sections of waveguide and to obtain very wideband responses. The low thickness of the lateral walls of the guided sections, typically smaller than the transmission wavelength, confer stability with incidence of the injected electromagnetic wave on the polarizing screen.

Figure 8:
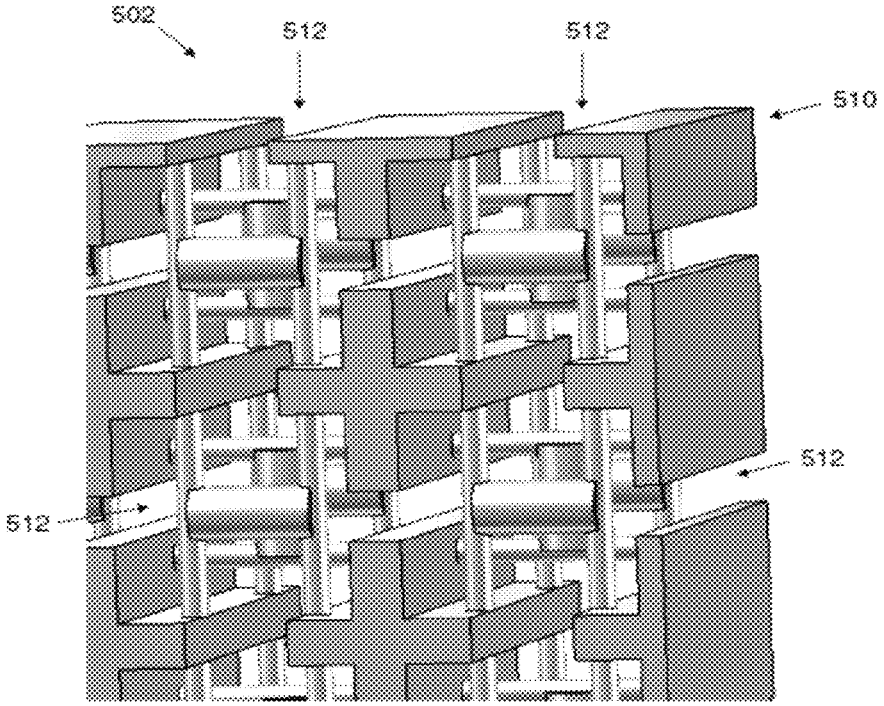
FIG. 8 shows a view of a second, two-dimensional, embodiment of a polarizing screen produced via a continuous and periodic two-dimensional arrangement of polarizing cells distributed over a plane, the structure of which is identical to that of the polarizing cell of FIG. 7A.

According to FIG. 8 and a first embodiment, a polarizing screen 502 is a continuous and periodic two-dimensional arrangement of polarizing cells 512 distributed over a planar surface and having a structure that is identical to that of the polarizing cell of FIG. 7A.

The polarizing cells 512 are formed here by metal guided sections 510 that are open on the sides due to longitudinal apertures. By virtue of the longitudinal apertures, the guides may propagate a TEM mode, which is not subject to a cutoff frequency.

The guided sections 510 are filled at a plurality of sites with metal patterns of a variety of shapes, joining the walls of the guides together, here three H-shaped metal patterns. These patterns allow the various portions of the structure of each polarizing cell to be rigidly connected and generally produce inductive or capacitive electrical loads, or parallel or series (LC) resonators.

Here, the H-shaped metal patterns linking the four angles of each guided section produce parallel (LC) resonators along the two polarizations, the L and C values of which for each polarization are determined by the geometry of said patterns. The width of the guided section and the width of the longitudinal apertures, here four slots of the same width, will determine the characteristic impedance of the guided section.

By virtue of the absence of a cutoff frequency, the periodic arrangement of the guided sections may be small relative to the wavelength (typically λ/3). Very wide bandwidths may be obtained, making it possible for example to cover the Rx and Tx sub-bands of the Ka band. The frequency response of the screen according to each polarization is primarily determined by the capacitive and inductive loads produced by the metal connections, and the characteristic impedances determined by the characteristics of the frame, acting as a parallel-plate waveguide.

Figure 9A:
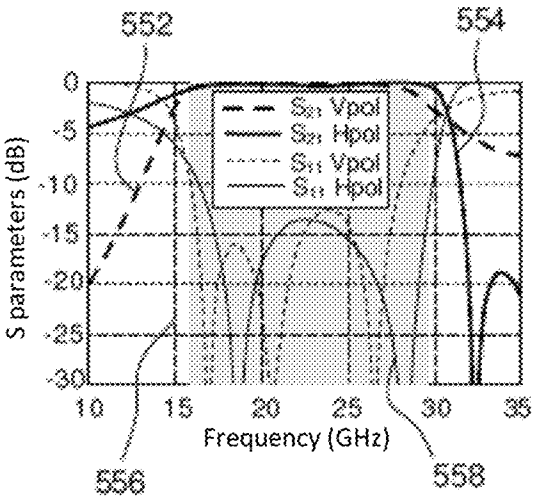
FIG. 9A.
Figure 9B:
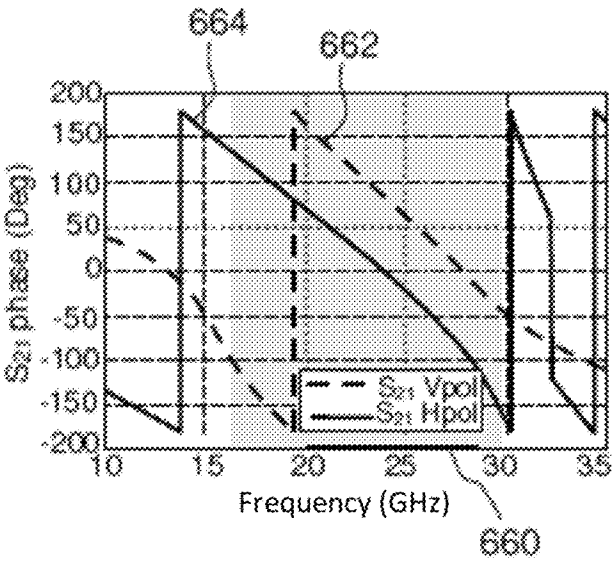
FIG. 9B.
Figure 9C:
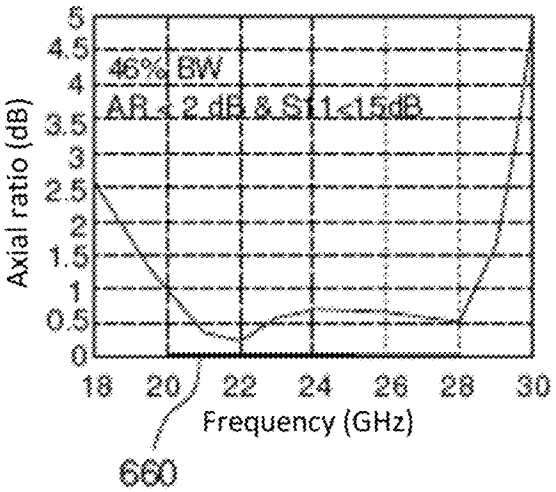
FIG. 9C show the radio performance of a two-dimensional polarizing screen having polarizing cells identical to that of FIG. 4A, with the curves of the variation in the parameters $S_{11}$, $S_{21}$ with frequency which highlight the matching for a wide band of Ka frequency band for the two electrical components $E_V$ and $E_H$ of the incident electromagnetic wave, the difference in phase between the two transmission coefficients $S_{21}$ for the two electrical components $E_V$ and $E_H$ of the incident electromagnetic wave, and the variation in the axial ratio with frequency over a wide band of Ka band, respectively.

According to FIGS. 9A to 9C, the radio performance of a planar two-dimensional polarizing screen having polarizing cells identical to those of FIG. 4A is illustrated.

According to FIG. 9A, the curves 552, 554, 556, 558 of the variation in the S parameters (transmission gain $S_{21}$ and return loss $S_{11}$) with frequency highlight the matching for a wide band of Ka frequency band for the two electrical components $E_V$ and $E_H$ of the incident electromagnetic wave, corresponding to the first, vertical polarization and to the second, horizontal polarization, respectively.

According to FIG. 9B, the variation of the difference in phase between the two transmission coefficients for the two electrical components $E_V$ and $E_H$ of the incident electromagnetic wave with frequency is illustrated.

Curve 662 describes the variation of the transmission coefficient for the vertical component $E_V$ of the incident electromagnetic wave, i.e. the first, vertical polarization, with frequency.

Curve 664 describes the variation of the transmission coefficient for the horizontal component $E_H$ of the incident electromagnetic wave, i.e. the second, horizontal polarization, with frequency.

An anisotropy of 90° between the two curves 662 and 664 can be seen in the frequency band 660 between 20 GHz and 28 GHz.

According to FIG. 9C, the variation in the axial ratio (AR) with frequency highlights an axial ratio close to 0 (lower than 1 dB) over the frequency band.

Figure 10A:
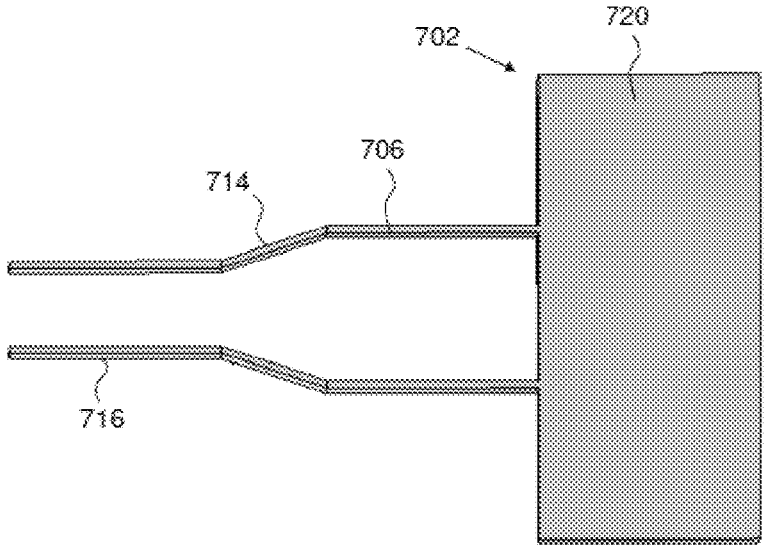
FIG. 10A.
Figure 10B:
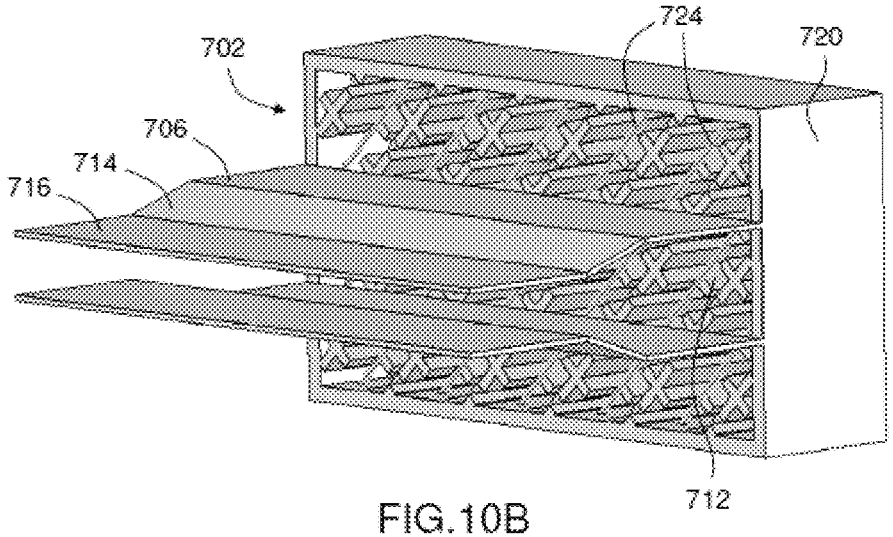
FIG. 10B show a side view and a perspective view, respectively, of a third, two-dimensional, embodiment of a planar polarizing screen, connected as input to a section of waveguide for injection of the incident electromagnetic wave, in which each polarizing cell has the same structure as that of the polarizing cell of FIG. 4A, and including a lateral supporting structure which surrounds the arrangement of the polarizing cells and fixes the positions of electrical discontinuity rods by completely rigidly connecting the polarizing cells.

According to FIGS. 10A and 10B and a second embodiment, a planar two-dimensional polarizing screen 702 according to the invention is connected as input to a section of waveguide 706 for injection of a linearly polarized incident electromagnetic wave.

The polarizing screen 702 is here a continuous and periodic planar two-dimensional arrangement of polarizing cells 712 each having the same structure as that described in FIG. 4A.

The section of waveguide 706 for injecting a linearly polarized incident electromagnetic wave here includes a widening 714, configured to modify the impedance of the parallel-plate waveguide 716 which precedes it upstream by matching it to the input impedance of the polarizing screen. The wider the widening, the closer the characteristic impedance will be to that of vacuum. In this case, the circuit diagrams of the polarizing screen 702 for the two orthogonal polarizations are similar to those of FIGS. 4A and 4B in which the input characteristic impedance Z0 of the screen corresponding to propagation in vacuum has been replaced with an impedance Zpp corresponding to the output characteristic impedance of the widening.

The polarizing screen 702 further comprises a lateral supporting structure 720 which laterally surrounds the polarizing cells 712 arranged together, and to which ends of rods 724 are attached, partially rigidly connecting the polarizing cells to one another.

Here, the polarizing cells 712 are completely rigidly connected to one another through the joint action of, on the one hand, the rods 720 passing through the polarizing-cell 712 guide-section walls in one and the same lateral direction, here the vertical direction of each polarizing cell, parallel to the first, vertical direction of polarization which corresponds to the direction of the incident field $E_V$ inclined by 45° relative to the vertical direction of FIG. 10B, and of, on the other hand, the supporting structure 720 which fixes the position of the linking rods 724.

The polarizing screen 702 is attached to the input section of waveguide 706 by two sets of attachments on input ends of polarizing-cell 712 waveguide-section walls, configured to be rigidly connected to lateral walls of the waveguide 706.

As a variant, the input waveguide is replaced with a horn output for injecting the incident electromagnetic wave.

Figure 11:
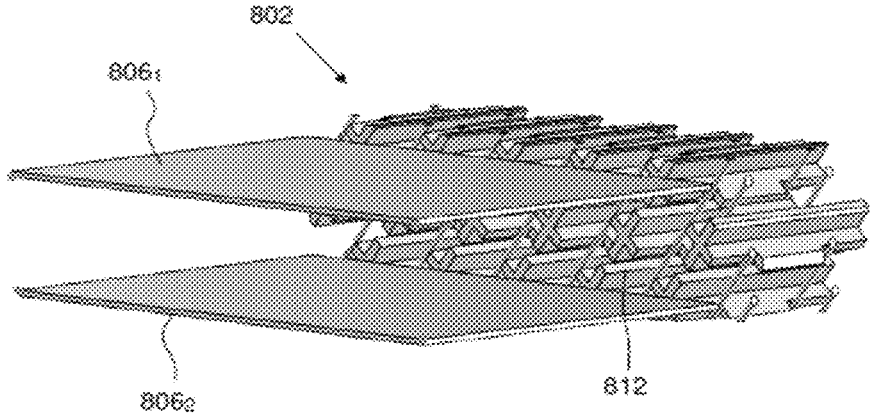
FIG. 11 shows a perspective view of a fourth, two-dimensional, embodiment of a planar polarizing screen, connected as input, without a lateral supporting structure, in which each polarizing cell has the same structure as that of the polarizing cell of FIG. 4A, and including two parallel plates for guiding and injecting the RF input signal, which are connected at input and at the end of lateral walls of polarizing cells.

According to FIG. 11 and a third embodiment, a planar polarizing screen 802 according to the invention is, like the planar two-dimensional polarizing screen 702 of FIGS. 10A and 10B, a continuous and periodic planar two-dimensional arrangement of polarizing cells 812 each having the same structure as that described in FIG. 4A.

Unlike the polarizing screen 702 of FIGS. 10A and 10B, the polarizing screen 802 is without a lateral supporting structure but comprises two plates $\mathbf{806}_1$, $\mathbf{806}_2$ for guiding and injecting the input signal that are connected as input to the assembly of the sections of waveguide forming the arrangement of the polarizing cells. These parallel plates may include a widening.

Here, the polarizing cells are completely rigidly connected to one another through the joint action of, on the one hand, the rods 820 passing through the polarizing-cell guide-section walls aligned in one and the same lateral direction, here the vertical direction of each polarizing cell, parallel to the first, vertical direction of polarization which corresponds to the direction of the incident field E inclined by 45° relative to the vertical direction of FIG. 11B, and of, on the other hand, the two plates $\mathbf{806}_1$, $\mathbf{806}_2$ for guiding and injecting the input RF signal which fix the positions of the grouped connecting rods of angled plates through links at the end of at least one angled plate per group of angled plates of the waveguide sections.

The arrangement of the polarizing cells is attached by the input end to the two plates for guiding and injecting the input RF signal by two sets of attachments on input ends of angled plates of polarizing-cell waveguide-section walls, configured to be rigidly connected to the two plates for guiding and injecting the linearly polarized input RF signal.

As a variant, in the second and third embodiments of FIGS. 10A and 10B and FIG. 1, a plurality of parallel-plate injection waveguides may be superposed. These parallel-plate injection waveguides may end in a plurality of superposed widenings.

Figure 12A:
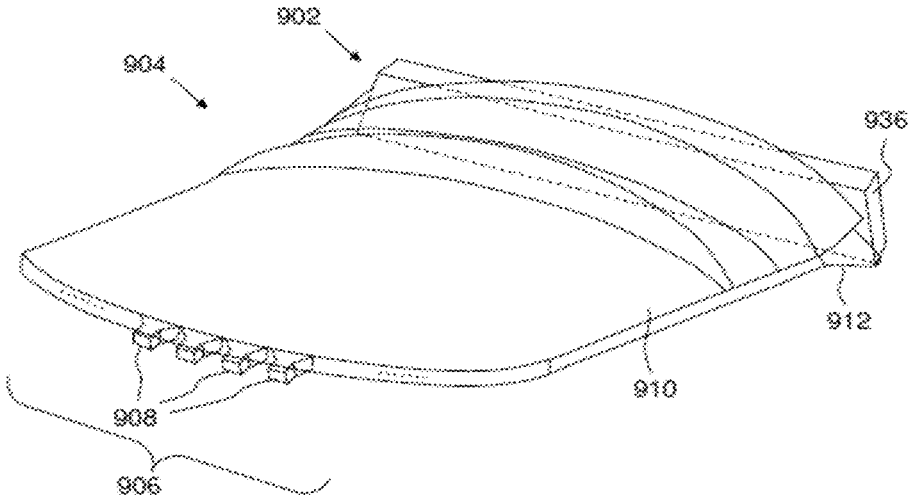
FIG. 12A shows a perspective view of a multibeam antenna within which a polarizing screen with a plurality of polarizing cells, similar to that described in FIGS. 10A-10B, is incorporated as output.
Figure 12B:
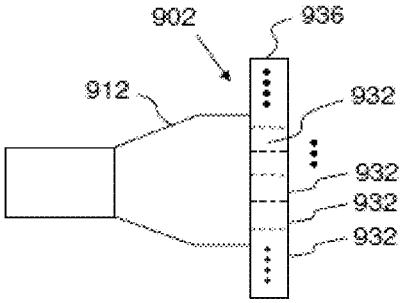
FIG. 12B shows an enlarged view of the longitudinal section of the polarizing screen, connected at the output of the multibeam antenna with a section of waveguide for injection of the linearly polarized electrical signal.

According to FIGS. 12A and 12B and an exemplary use of a polarizing screen according to the invention, a planar two-dimensional polarizing screen 902, of identical structure to that of FIGS. 10A and 10B, is incorporated within a multibeam antenna 904, formed by an array 906 of linearly polarized TEM wave RF sources 908 and a beamformer 910 such as described in patent FR 3038457 B1. The beamformer 910 is a waveguide having parallel plates making it possible to form a plurality of beams over a wide angular sector. The RF sources 908 which supply the beamformer 910 are here horn sources, of which four are shown here.

The multibeam antenna 904 is configured to radiate from a continuous aperture, formed by a section of waveguide 912 for injecting a linearly polarized incident electromagnetic wave similar to that described in FIGS. 10A and 10B.

The polarizing screen 902 is a continuous and periodic planar two-dimensional arrangement of polarizing cells 932 each having the same structure as that described in FIG. 4A. The polarizing screen 902 further comprises a lateral supporting structure 936 which laterally surrounds the polarizing cells 932 arranged together, and to which ends of rods are attached, partially rigidly connecting the polarizing cells to one another.

The polarizing screen 902 is connected to the output of the section of waveguide 912 for injecting a linearly polarized incident electromagnetic wave in a similar way to that described in FIGS. 10A and 10B.

A method for producing a polarizing screen according to the invention such as described above may advantageously use a 3D-printing technique when the polarizing cells (guided sections and interconnecting rods) are made entirely of metal.

The polarizing cells according to the invention are dimensioned to operate in a frequency band included in one of the L, S, C, Ku and Ka bands.

A number of applications may be covered by a polarizing screen according to the invention such as described above, such as for example:

on-board multibeam antennas on board space telecommunications system satellites based on constellations of satellites travelling in LEO (low Earth orbit) or MEO (medium Earth orbit);

antennas for SATCOM communication terminals; or user terminals for telecommunications systems based on constellations of satellites in LEO (low Earth orbit) or MEO (medium Earth orbit).

The invention claimed is:

1. A polarizing screen comprising an arrangement of at least one polarizing cell made of an electrically conductive material, which at least one cell is frequency- and polarization-selective, for transforming a linear polarization of an electric field E of an incident transverse electromagnetic (TEM) wave, which field is received as input and is decomposable into two electric field signals $E_V$, $E_H$, vertical and horizontal polarizations of which are linear and orthogonal, into a circular polarization of an output electric field, and wherein each polarizing cell includes a section of waveguide having four lateral walls formed by two orthogonal, vertical and horizontal, pairs of lateral walls that are parallel to one another and run longitudinally in a direction of propagation of the incident transverse electromagnetic (TEM) wave, the polarizing screen being wherein the four lateral walls are each open over their entire length due to a median continuous slot, parallel to the direction of propagation of the incident transverse electromagnetic wave, so as to form four angled electrically conductive plates, and each polarizing cell includes electrically conductive rods which interconnect the four lateral walls and the four angled plates so that they are partially or completely rigidly connected and which form one or more successive elementary electrical discontinuities, which are arranged at an end of or inside the section of waveguide forming at least one polarizing cell and form one or more inductive or capacitive loads, or one or more (LC) resonators equivalent to an inductor and a capacitor connected in parallel or in series; and longitudinally open slots, of the four lateral walls and the elementary electrical discontinuities of each polarizing cell include geometric shapes and dimensions which provide total transmission of the incident wave, which is associated with a phase anisotropy of +90° or −90° according to the components $E_V$ and $E_H$.

2. The polarizing screen according to claim 1, wherein the sections of waveguide and the interconnecting rods, each forming the at least one polarizing cell, which are electrically conductive, are made of:

a single electrically conductive homogeneous material, or a first material covered with a second, electrically conductive material.

3. The polarizing screen according to claim 2, wherein the single electrically conductive homogeneous material is a metal, or the second, electrically conductive material is a metal.

4. The polarizing screen according to claim 1, wherein:

the median continuous slots of the four lateral walls of each section of waveguide forming a polarizing cell are indented at the input and at the output of the section of the waveguide;

the median continuous slots of a single pair of parallel lateral walls of each section of waveguide forming a polarizing cell are indented at the input and at the output of the section of the waveguide; or the median continuous slots of the four lateral walls of each section of waveguide forming a polarizing cell are without indentation at the input and at the output of the section of the waveguide.

5. The polarizing screen according to claim 1, wherein:

the polarizing cells are dimensioned to operate in a frequency band included in one of the L, S, C, Ku and Ka bands.

6. The polarizing screen according to claim 1, wherein:

each of the polarizing cell rods are made of the electrically conductive material, for interconnecting the four lateral walls via an H-shaped interconnection, producing a single elementary electrical discontinuity, and the H-shaped interconnection forming the elementary electrical discontinuity, arranged inside the section of waveguide and substantially in the middle of the length of the polarizing cell, consists of two first, vertical rods of the same length and of a second, horizontal rod linking said two vertical rods substantially at their middles, the two first, vertical rods connecting a pair of, upper and lower, horizontal lateral walls so as to produce a first parallel resonator circuit $L_V$, $C_V$ for a first, vertical polarization, and a second parallel resonator circuit $L_H$, $C_H$ for a second, horizontal polarization, orthogonal to the first, vertical polarization.

7. The polarizing screen according to claim 1, wherein:

each of the polarizing cell rods are made of the electrically conductive material, for interconnecting the four lateral walls via an X-shape, producing a single elementary electrical discontinuity, and the X-shaped interconnection producing the single elementary electrical discontinuity, arranged inside the section of waveguide substantially in the middle of the length of the polarizing cell and symmetrically relative to a longitudinal median plane passing through the section of waveguide, consists of two rods of the same length, inclined relative to a vertical direction but in opposite directions, which intersect substantially at their respective middles while being linked or slightly separated at their middles, and which connect a pair of, upper and lower, horizontal lateral walls so as to produce a first parallel resonator circuit $L_V$, $C_V$ for a first, vertical polarization, and a second parallel resonator circuit $L_H$, $C_H$ for a second, horizontal polarization, orthogonal to the first, vertical polarization.

8. The polarizing screen according to claim 1, wherein:

each of the polarizing cell rods are made of the electrically conductive material, for interconnecting the four lateral walls, via two interconnections, each formed by two vertical rods or vertical pillars without a central connection between them, and each producing an elementary electrical interconnection; and the two, first and second, interconnections producing the two elementary electrical discontinuities, arranged inside the section of waveguide forming the polarizing cell and set back from the respective input and output ends of said section of waveguide, connect the two, lower and upper, horizontal lateral walls so as to produce an inductive load for the first, vertical polarization, parallel to the direction of the vertical rods, and a capacitive load for the second, horizontal polarization, orthogonal to the first, vertical polarization.

9. The polarizing screen according to claim 1, wherein:

each of the polarizing cell rods are made of the electrically conductive material, for interconnecting the four lateral walls via two successive H-shaped interconnections, producing two elementary electrical discontinuities; and the two, first and second, successive interconnections forming the two elementary discontinuities, arranged inside the section of waveguide forming the polarizing cell and set back from the respective input and output ends of said section of waveguide, each consist of two first, vertical rods of the same length and of a second, horizontal rod linking said two vertical rods substantially at their middles, the two first, vertical rods connecting the, upper and lower, horizontal lateral walls so as each to form a first parallel resonator circuit $L_V$, $C_V$ for the first, vertical polarization, and a second parallel resonator circuit $L_H$, $C_H$ for the second, horizontal polarization, orthogonal to the first, vertical polarization.

10. The polarizing screen according to claim 1, wherein:

each of the polarizing cell rods are made of the electrically conductive material, for interconnecting the four lateral walls via two X-shaped interconnections, producing two elementary electrical discontinuities; and the two, first and second, successive interconnections forming the two elementary discontinuities, arranged inside the section of waveguide forming the polarizing cell and set back from the respective input and output ends of said section of waveguide and symmetrically relative to a vertical median plane passing longitudinally through the section of waveguide, each consist of two rods of the same length, inclined relative to a vertical direction but in opposite directions, which intersect substantially at their respective middles while being linked or slightly separated at their middles, and which connect the two, lower and upper, horizontal lateral walls, so as each to form a first parallel resonator circuit $L_V$, $C_V$ for the first, vertical polarization, and a second parallel resonator circuit $L_H$, $C_H$ for the second, horizontal polarization, orthogonal to the first, vertical polarization.

11. The polarizing screen according to claim 1, wherein:

each of the polarizing cell rods are made of the electrically conductive material, for interconnecting the four lateral walls via two, first and second, H-shaped interconnections of a first type, producing two elementary electrical discontinuities of a first type, and via a third H-shaped interconnection, of a second type, producing an elementary electrical discontinuity of a second type; and the two, first and second, H-shaped interconnections of the first type, arranged inside the section of waveguide forming the polarizing cell and set back from the respective input and output ends of said section of waveguide, each consist of two first, vertical rods of the same length and of a second, horizontal rod linking said two vertical rods substantially at their middles, the two first, vertical rods connecting the two, lower and upper, horizontal lateral walls so as each to form a first parallel resonator circuit $L_{V1}$, $C_{V1}$ of a first type for a first, vertical polarization, and a second parallel resonator circuit $L_{H1}$, $C_{H1}$ for a second, horizontal polarization, orthogonal to the first, vertical polarization; and the third H-shaped interconnection, of the second type, arranged inside the section of waveguide and substantially in the middle of the length of the polarizing cell, consists of two third, horizontal rods of the same length and of a fourth, vertical rod linking said two third, horizontal rods substantially at their middles, the two third, horizontal rods connecting the, left and right, vertical lateral walls so as to produce a first parallel resonator circuit $L_{V2}$, $C_{V2}$ of a second type for the first, vertical polarization, and a second parallel resonator circuit $L_{H2}$, $C_{H2}$ of a second type for the second, horizontal polarization.

12. The polarizing screen according to claim 1, further comprising:

a lateral supporting structure which laterally surrounds the arrangement of the polarizing cells and to which ends of rods are attached, partially or completely rigidly connecting each polarizing cell; or two parallel plates for guiding and injecting the, linearly polarized, incident electrical signal, which are attached at the end of walls of polarizing cells so as to rigidly connect the polarizing cells of the polarizing screen in cooperation with interconnection rods rigidly connecting groups of polarizing cells.

13. The polarizing screen according to claim 1, wherein the arrangement of the polarizing cells is a continuous two-dimensional arrangement of at least three polarizing cells distributed over a regular surface.

14. A method for producing a polarizing screen such as defined in claim 1, wherein the polarizing screen is made entirely of metal, and the production method uses a 3D-printing technique.

* * * * *